United States Patent [19]

Fesko

[11] Patent Number: 4,994,947

[45] Date of Patent: Feb. 19, 1991

[54] REFLECTOR AND LIGHTING FIXTURE COMPRISING SAME

[75] Inventor: Donald G. Fesko, Allen Park, Mich.

[73] Assignee: Ford Motor Company, Dearborn, Mich.

[21] Appl. No.: 438,559

[22] Filed: Nov. 20, 1989

[51] Int. Cl.[5] ..... F21V 7/00

[52] U.S. Cl. ..... 362/297; 362/348

[58] Field of Search ..... 362/297, 346, 347, 348

[56] References Cited

U.S. PATENT DOCUMENTS

| | | | |
|---|---|---|---|
| 1,555,410 | 9/1925 | Godley | 362/348 |
| 2,119,992 | 4/1935 | Johnson . | |
| 3,283,142 | 11/1966 | Freeman | 362/298 |
| 4,021,659 | 5/1977 | Wiley | 362/297 |
| 4,124,882 | 11/1978 | Kawamura et al. . | |
| 4,425,604 | 1/1984 | Imai et al. . | |
| 4,517,630 | 5/1985 | Diffenbach et al. . | |
| 4,556,928 | 12/1985 | Tysoe . | |
| 4,630,184 | 12/1986 | Ferrero . | |
| 4,706,173 | 11/1987 | Hamada et al. . | |
| 4,789,923 | 12/1988 | Sales . | |
| 4,794,504 | 12/1988 | Creff . | |
| 4,799,136 | 1/1989 | Molnar . | |

*Primary Examiner*—Allen M. Ostrager

*Attorney, Agent, or Firm*—Peter D. McDermott; Roger L. May

[57] ABSTRACT

A reflector for a lighting unit and a lighting unit comprising the same is disclosed. The reflector has a generally concave surrface, at least a portion of which concave surface is a series of facets. Each facet has a reflective surface area which is convex. Overlap of the light reflected from the reflective surface areas of adjacent facets provides substantially even illumination of a lens or other object.

16 Claims, 1 Drawing Sheet

REFLECTOR AND LIGHTING FIXTURE COMPRISING SAME

BACKGROUND OF THE INVENTION

1. Introduction

This invention relates to improved light reflectors and to lighting fixtures comprising such reflectors. More particularly, it relates to concave shaped reflectors having multiple asymmetric reflective facets, the configuration and orientation of which facets provide more uniform light distribution through a lens of a lighting fixture.

2. Background

A typical lighting fixture, consisting of a bulb or other light emitting element, a lens and a reflector to direct light through the lens will display an uneven light intensity over the lens area. Such unevenness of light intensity frequently is undesirable, as for example in certain automotive lighting applications. Emitted light may be uneven over the lens area as a whole and/or within multiple sub-sections of the lens area. Specifically, for example, it is typical with parabolic and most fresnel reflectors that light intensity decreases with distance from the light emitting element. The lens may include surface configurations or other optical features to direct or otherwise effect the emitted light.

In U.S. Pat. No. 4,706,173 to Hamada et al a lighting apparatus is disclosed which includes a large tubular light source and a reflector having a plurality of reflective surfaces. The reflective surfaces are angularly set such that light from the light source is reflected in a predetermined direction. The "apparent width" of each adjacent reflective surface is determined as a function of the distance between the light source and the reflective surface. The result of this and the large size of the tubular light source is said to be a light display of uniform illumination. The Hamada et al lighting apparatus is said to be usable as a backlight for a liquid crystal display. A set of equations is given in Hamada et al for calculating the angles and dimensions of a series of reflective facets in a concave reflector. A concave reflector formed in accordance with such equations will have a series of reflective surfaces each of which has luminance equal to that of the others, regardless of the distance between the reflective surface and the light source. Unfortunately, however, as pointed out by Hamada et al (Column 5, lines 53–57), the light from the resulting product (as is typical for lighting units employing "fresnel" type reflectors) "will have a striped appearance in which the shining reflective surfaces 20A and the unshining surfaces 20B are arranged alternately". To overcome this problem Hamada et al suggest a diffusing plate, for example, a milky plastic plate. It is suggested that if the pitch of the reflective surface (relative the intending viewing angle) is small compared with the radius of the light source, and the reflective surface and the diffusing surface are spaced at least a predetermined distance away from each other, then the surface portions of the diffusing plate illuminated by adjoining reflective surfaces 20A will overlap each other and result in a uniform illumination. FIG. 6 is cited as an example of such arrangement of the reflective facets of the reflector but does not show the diffusing plate. Hamada et al is directed only to a large cylindrical light source and reflector.

In U.S. Pat. No. 4,799,136 to Molnar a lighting fixture is shown having an elongated concave shaped reflector containing multiple reflective facets. The angles of the facets are selected to provide uniform illumination of a remote wall surface by the lighting fixture. The concave shaped reflector includes a major length rear portion and a minor length front portion. Each such portion, which face toward each other, has multiple reflecting facet surfaces. Light is reflected from the reflector facet surfaces in the major length rear portion directly outwardly through a diffusion plate. Some of the facet surfaces on the minor length front portion reflect light through the diffusion plate, while others reflect light partially against the facets in the opposite major length rear portion of the reflector. In the Molnar lighting fixture the numerous reflecting facets have varying angles selected to provide intersecting reflections to produce an asymmetric light pattern said to provide uniform distribution of light onto a wall. As seen in FIGS. 3 and 4 of Molnar, the lighting fixture is intended to provide uniform illumination of a wall when the lighting fixture is mounted from a ceiling near the top of such wall. Light must be emitted from the diffuser plate of Molnar unevenly, such that illumination of the remote bottom of the wall is uniform with that of higher portions of the wall closer to the lighting fixture.

It is an object of the present invention to provide a reflector and a lighting fixture comprising the same having a substantially uniform illumination through a lens of such lighting fixture. This and additional objects of the invention, or of particular preferred embodiments of the invention, will be better understood from the following disclosure and discussion thereof.

SUMMARY OF THE INVENTION

According to the present invention, a reflector for a lighting unit has a generally concave surface, at least a portion of which concave surface is a series of facets. Each such facet has a reflective surface area which would be exposed to a light emitting element to reflect light therefrom toward a lens or other object. Each reflective surface area is convex. Thus, a concave area of the reflector has a series of convex reflective surfaces.

According to another aspect of the invention, a lighting unit comprises a light emitting element and a reflector as described immediately above. In this aspect of the invention the convex reflective surface area of each of the facets on the concave reflective surface is exposed to the light generating element and is so oriented as to reflect light from the light emitting element, optionally through a lens.

BRIEF DESCRIPTION OF THE DRAWINGS

The invention, along with the advantages and specific features of preferred embodiments thereof, will be better understood from the detailed description which follows wherein reference is made to the accompanying drawings. Illustrations of various dimensions and angles are approximate.

DETAILED DESCRIPTION OF PREFERRED EMBODIMENT

Figure 1:
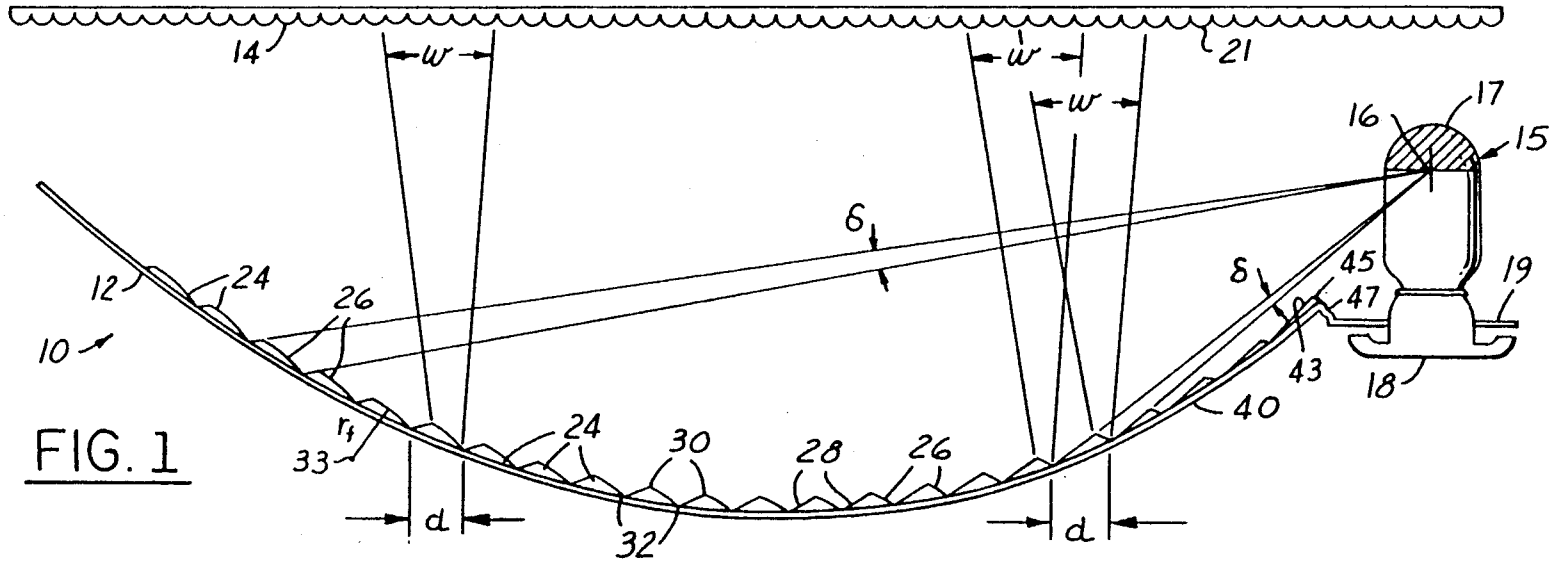
FIG. 1 is a schematic cross-sectional view of a lighting unit comprising a reflector according to a preferred embodiment of the present invention.

All references herein to the line (or line of sight) between the light emitting element and the reflective surface of a reflector facet or to the angle of incidence or reflection at a reflective surface, unless otherwise stated, should be taken as running from the center point of the filament or other light source of the light emitting element to the vertical (as viewed in the drawings) midpoint of the reflective surface. Since each reflective surface is convex, the angle of incidence (and, therefore, of reflection) will vary slightly from top to bottom of the reflective surface. Also, for purposes of this discussion (again, unless otherwise stated) the plane of the reflective surface of a facet should be taken as being at the tangent to the convex curve of the reflective surface at the vertical midpoint of the surface or, alternatively, in the plain of the line running from the bottom to the top end points of the reflective surface (again, referring to the two-dimensional cross-section of the reflective surfaces as depicted in the drawings; thus the top end point of the reflective surface area is remote from the primary concave plane of the reflector, while the bottom end point of the reflective surface area is proximate the concave plane of the reflector). Normally, where the convex curve of the reflective surface is an arc of a circle (i.e., has a constant radius of curvature), which is preferred, these two planes will be parallel. While the convex surface of each reflective facet preferably is smooth and continuous, preferably curvo-planar, it need not be an arc of a circle. If it is not an arc of a circle, the two planes just referred to may not be precisely parallel, but the difference would generally be quite small and this will not cause any confusion in the understanding of the invention by those skilled in the art. The most notable impact of a curvo-planar reflective surface which is not an arc of a circle will be to somewhat shift the zone of reflected light at the lens of the lighting unit. It will still be possible, however, to provide overlapping zones of light to achieve the desired objective of substantially uniform illumination. Also, the radius of curvature of the convex reflective surface of one facet is generally not identical to that of another facet. The radius of curvature tends to increase with distance from the light source; although typically then decreases at the far extremity.

It should be understood that reference herein to overlapping zones of reflective light refer to the main zone of reflected light from a reflective surface of a facet, illustrated for several facets as zone w in FIG. 1. There generally would be incidental scattered light owing to imperfections in the reflective surfaces, end effects at the top and bottom of the reflective surfaces, the finite size of the light emitting element (as opposed to an infinitely small point source of light) and like factors. According to the present invention, overlapping zones of reflected light are provided without reference to such incidental scattered light.

With respect to the discussion of the invention in terms of the two-dimensional cross-section view shown in the drawing, it should be understood that in an actual three-dimensional embodiment of the invention there may longitudinal and/or lateral extremities of the facets at which the reflective surfaces do not follow the form and geometric interrelationships described for the main area of the reflective surface. The configuration of such extremities may be influenced by considerations such as manufacturing ease and space availability or other "packaging" limitations, etc.

Referring now to the drawings, the reflector illustrated is of a type frequently referred to as a fresnel reflector. Such reflectors are well known in the art. As discussed above, however, fresnel reflectors frequently are criticized as producing an uneven lighting pattern, wherein light and dark zones alternate with one another, and light intensity diminishes with distance from the light source. A more uniform illumination is achieved by the improved reflector of the present invention. In FIG. 1 a lighting unit 10 is depicted which might form, for example, one half of a tail lamp for a motor vehicle. Lighting unit 10 comprises concave reflector 12, planar or curvo-planar lens 14 vertically spaced from reflector 12, and a light emitting element 15. Light emitting element 15 is seen to comprise a filament 16 housed within lightbulb 17 which is mounted in fixture 18 seated in bracket 19. Any lightbulb or other lighting means capable of providing light of intensity sufficient for the intended purpose and having a size, configuration and power requirement which can be accommodated by the lighting unit and its environment can be used. Numerous such lightbulbs and other light emitting means are commercially available and well known to the skilled of the art.

The lens may be a simple, clear protective covering for the lighting unit or may be colored or frosted or otherwise translucent, depending upon the intended purpose of the lighting unit. For a uniform lighting effect the lens would have suitable lens optics for diffusing the light, such as "pillows", frosting, etc. In the embodiment shown in FIG. 1, pillows 21 are provided to aid in even illumination. The lens may be constructed of glass, plastic or other materials suitable for the intended purpose and environment of the lighting unit. Lenses suitable for the invention and having the various features mentioned above are commercially available and well known to the skilled of the art.

Concave reflector 12 is seen to have a series of facets 24 in its concave area. Each such facet is seen to have a reflective surface area 26 exposed to light emitting element 15. Each facet 24 also has a back surface area 28 which is not exposed to light emitting element 15 but which, rather, extends from the outermost point (outer edge or top) 30 of the reflective surface area 26 of that facet to the innermost point (inner edge or bottom) 32 of the reflective surface area 26 of the adjacent facet (moving outwardly from the light emitting element 15). The back surface area 28 is seen to extend substantially parallel to the direction of travel of light from the light emitting element to its intersection with the inner edge 32 of the reflective surface area of the next adjacent facet. Thus, the back surface area 28 of a facet does not cast a shadow on the reflective surface area 26 of the next adjacent facet. It should be understood that in other embodiments of the invention, facets may have multiple reflective surfaces exposed to a light source.

As disclosed above, the reflective surface area 26 of each facet 24 is convex. Preferably, each such surface is curvo-planar and, even more preferably, is an arc of a circle, that is, has a substantially constant radius of curvature $r_f$. As seen in FIG. 1, the radius of curvature $r_f$ for each facet rotates about a point of rotation 33 which can be defined by coordinates x,y along axes x and y shown in FIG. 2. It should be understood that the radius of curvature generally would be quite small. In a typical motor vehicle tail lamp application of the invention the reflector would extend laterally on both sides of the light source, such that FIG. 1 would depict only one of two symmetrical halves of the reflector. Each side would have an overall lateral dimension, the so called half width dimension W/2 (see FIG. 2), of perhaps 3 to 10 inches subdivided into a series of about 4 to 40 facets. The vertical dimension of each facet (measured to the outer edge 30 from the concave plane of the reflector) and the radius of curvature of each facet is determined by its location and orientation in accordance with the principles set forth herein. In an actual three dimensional embodiment, typically and preferably the two halves of the entire reflector would be rotationally symmetrical about the axis of the light source, the two sides being segments of a dish shape.

Referring again to the preferred embodiment of the drawing, each reflective surface area 26 is oriented to reflect light in a common direction (measured approximately at the midpoint of convex curvature of the reflective surface area between the inner edge 32 and the outer edge 30), specifically, in a direction substantially normal to the lens. Since the angle of incidence of light on the reflector changes with distance from the light emitting element 15, so too must the angle of orientation of the reflective surface area 26, i.e., the angle between vertical and the reflective surface. The angle increases from one facet 24 to the next with distance from the light emitting element 15. It will be seen also that the reflective surface area 26 of each facet 24 is larger than that of the facet next closest to the light emitting element 15. More particularly, the size of each reflective surface area 26 is such as to intercept an equal angle, δ, of light from the light emitting element 15. As is well known, light intensity diminishes with the square of the distance from the light source. Correspondingly, therefore, the effective dimension of exposed reflective surface areas 26 must increase in like proportion. In this way, each reflective surface area 26 will intercept and reflect to the lens an equal amount of light to provide even more uniform illumination of lens 14 by reflector 12. In the lens illustrated in FIG. 1, each facet 24 has a lateral dimension d. Dimension d is the same for each facet. Since, the lateral dimension of the reflective surface area 26 of the facets increases with distance from the light emitting element 15, the lateral dimension of the back surface area 28 must correspondingly decrease.

The light reflected from light emitting element 15 to lens 14 by each reflective surface area 26 has a lateral dimension at lens 14 greater than the lateral dimension of the reflective portion of the facet as a result of the finite size of the light emitting element and the reflective surface. This effect is significantly increased by the convex configuration of the reflective surfaces 26, most preferably, sufficiently increased such that dimension w is greater than dimension d so that the illuminated portions of the lens overlap each other. The lateral dimension of the reflected light, w, is illustrated in the drawing for several exemplary reflective surface areas 26. The light which is emitted from the light emitting element 15 through angle δ is spread by the convex reflective surface area to lateral dimension w, greater than d, such that it will inherently and unavoidably overlap significantly with the light reflected by the reflective surface area 26 of the next adjacent facet 24 on both sides. Thus, in short, equal angles of light, δ, are parcelled to equal segments of lens, d, at each of which the light is intercepted by a convex reflective surface and spread to width w to overlap with the light reflected from adjacent segments to provide uniform illumination and eliminate shadows. The overlap preferably is about 50%, the lateral dimension w being approximately centered on lateral dimension d and twice the value of lateral dimension d. The amount of overlap, however, is variable and within the control of the lighting unit designer.

In the preferred embodiment of FIG. 1, the first facet 43 has convex reflective surface 45 below which (to the right) the reflector has a reflective optic 47. Reflective optic 47 is concave, but also could be convex. It will be understood by those skilled in the art in view of the present disclosure that this end region of the reflector can have additional optical elements to deal with end effects and the like. Also, the top of Lightbulb 17 is blocked out to avoid a bright spot.

By virtue of the present invention, a lighting unit can be designed and constructed which is quite thin (small in the vertical direction), yet which does not suffer the disadvantage of uneven illumination so typical of fresnel type reflectors and lighting units. A highly efficient use of light is achieved with exceptionally high uniformity of illumination.

The reflector 12 can be made of any suitable material which is dimensionally stable and can be polished, plated or otherwise provided with a highly reflective surface at the reflective surface areas 26 of the facets 24 on the concave surface of the reflector. Suitable materials include, for example, glass, plastic, aluminum and other metals, and the like. Thus, the reflector can be produced by numerically controlled machining, e.g., by milling or turning, commercially available metal stock. One preferred material is injection molded plastic, wherein the reflective surface areas 26 are made reflective by vacuum metalization. Known manufacturing techniques for reflectors generally are applicable to the present invention. The back surface area of a facet may be recessed somewhat to accommodate any build-up of coating material to be applied to the reflector. Other techniques and materials will be readily apparent to the skilled of the art in view of the present disclosure.

Figure 2:
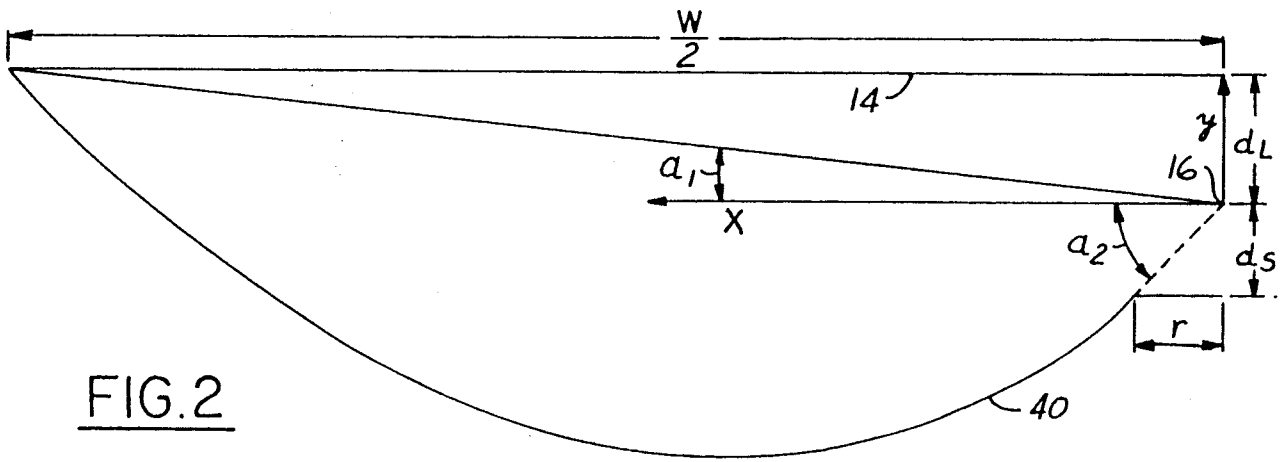
FIG. 2 is a schematic diagram of the reflector of FIG. 1, reduced in scale and without the reflective facets, wherein certain angles and dimensions are labeled for discussion purposes.

The overall curve 40 of the concave surface of the reflector of the preferred embodiment of FIG. 1 is schematically illustrated in FIG. 2 and is described by the equation:

$$y = (-x) \cdot \mathrm{Tan}\left[ a_1 - \frac{x - r}{\frac{W}{2} - r} \cdot (a_1 + a_2) \right]$$

$$\text{for } x \geqq r$$

(the origin being at the centerpoint of the light source of the light emitting element), W/2 is the lateral dimension, or half width, of the operative portion of the reflector and lens of the light fixture (the light emitting element 15 being disposed to one side, i.e., laterally, of the lens and reflector), and r is the radius of the socket/bracket assembly (the concave curvature of the reflector commencing at the outer periphery of the socket/bracket assembly). The angles $a_1$ and $a_2$ are defined as follows:

$$a_1 = \mathrm{Tan}^{-1}\left(\frac{d_s}{W/2}\right)$$

-continued and $$a_2 = \mathrm{Tan}^{-1}\left(\frac{d_L}{r}\right)$$

wherein $d_s$ is the vertical height of the light emitting element 15 above the reflector at the first facet, $d_L$ is the vertical height of the lens 14 above the light emitting element 15 and the other variables are as defined above. Given this curvature for the reflector, the configuration of the facets is determined by selecting the number of facets. In a simple reflector the dimension d is the same for each facet and is equal to W/2 divided by the number of facets. The vertical height of each facet is that required to intercept the light through its respective angle δ from the light emitting element, the same angle δ being intercepted by each reflector surface segment of lateral dimension d. Alternatively, the angle δ can be selected and this will determine the dimension d and the number of facets. The angle of orientation of the reflective surface area of each facet is that required to reflect the light from the light emitting element to the lens. The degree of convexity of the reflective surfaces of the facets is determined by the desired degree of overlap the light reflected by adjacent facets. In some cases it may even be desirable to overlap the light reflected by a facet not only with that of the immediately adjacent facet (on either side) but also one or more of the next proximate facets.

The invention will now be further described by the following example.

EXAMPLE 1

A thin, uniformly lit tail lamp for a motor vehicle is constructed comprising a reflector, one half of which is as depicted in FIG. 1 and has a lateral dimension or half width W/2 of 8.5 inches measured from a standard motor vehicle type lightbulb mounted in the reflector. A substantially flat lens is spaced vertically from the bulb filament a distance $d_L$ equal to 0.75 inch (references to vertical being in accordance with the orientation of FIG. 1 and actually being substantially horizontal in the typical motor vehicle tail lamp). The radius r is 0.75 inch also, as is vertical distance $d_s$. The reflector is divided into a series of 16 facets, each having the same lateral dimension d of 0.485 inch and each having a reflective surface with a substantially constant radius of curvature $r_f$. In the table below are given the numerical values defining each facet, including the dimension of $r_f$ and the coordinates x,y of the point of rotation of the convex reflective surface 26 and the coordinates x,y of points 30 and 32 of each facet. The bulb filament is at the origin, as in FIG. 2 and facet number 1 is that closest to the bulb.

TABLE 1

| Facet | Point 32 | | Point 30 | | Convex Facet | | |
|---|---|---|---|---|---|---|---|
| No. | x | y | x | y | $r_f$ | x | y |
| 1 | .750 | 1.5 | .814 | 1.480 | .206 | .843 | 1.683 |
| 2 | 1.234 | 1.856 | 1.334 | 1.819 | .410 | 1.426 | 2.220 |
| 3 | 1.719 | 2.129 | 1.849 | 2.075 | .641 | 2.028 | 2.691 |
| 4 | 2.203 | 2.328 | 2.363 | 2.255 | .897 | 2.654 | 3.104 |
| 5 | 2.688 | 2.461 | 2.876 | 2.368 | 1.163 | 3.296 | 3.452 |
| 6 | 3.172 | 2.534 | 3.387 | 2.419 | 1.426 | 3.949 | 3.729 |
| 7 | 3.656 | 2.552 | 3.898 | 2.413 | 1.675 | 4.607 | 3.931 |
| 8 | 4.141 | 2.517 | 4.408 | 2.353 | 1.898 | 5.261 | 4.048 |
| 9 | 4.625 | 2.431 | 4.919 | 2.240 | 2.082 | 5.903 | 4.075 |
| 10 | 5.109 | 2.298 | 5.431 | 2.077 | 2.213 | 6.520 | 4.003 |
| 11 | 5.594 | 2.116 | 5.944 | 1.862 | 2.276 | 7.099 | 3.823 |
| 12 | 6.078 | 1.887 | 6.460 | 1.596 | 2.263 | 7.632 | 3.533 |
| 13 | 6.563 | 1.610 | 6.980 | 1.279 | 2.133 | 8.085 | 3.104 |
| 14 | 7.047 | 1.285 | 7.511 | 0.909 | 1.879 | 8.447 | 2.538 |
| 15 | 7.531 | 0.909 | 8.072 | 0.480 | 1.492 | 8.705 | 1.831 |
| 16 | 8.072 | 0.480 | 8.500 | 0.000 | — | — | — |

Although this invention has been described broadly and in terms of preferred embodiments, it will be understood that modifications and variations may be made within the scope of the invention as defined by the following claims.

What is claimed is:

1. A lighting unit comprising a light emitting element, a reflector having a generally concave surface exposed to said light emitting element and a generally planar lens spaced from said reflector, at least a portion of said concave surface being a series of facets, each said facet having a reflective surface area exposed to said light emitting element and a back surface area extending approximately from the outer edge of the reflective surface area of that facet to the inner edge of the reflective surface area of the adjacent facet and lying in a plane substantially parallel to the direction of travel of light from said light source location to the intersection of said back surface area with the reflective surface area of said adjacent facet, each said reflective surface area being (a) convex with a substantially constant radius of curvature, (b) oriented to reflect light through said lens in a direction approximately normal to the plane of said lens, measured approximately at its midpoint of convex curvature, (c) laterally larger than that of the facet next closest to said light emitting element, intercepting an angle δ of light from said light emitting element wherein δ is the same for all said facets, while the lateral dimension, d, of each said facet, being the sum of the lateral dimensions of the back surface area and of the reflective surface area of said facet, is equal to that of the other said facets, and (d) sufficiently convex to cause substantial overlapping at said lens, laterally, of light reflected by it to said lens with light reflected by the reflective surface area of adjacent facets, the lateral dimension, w, at said lens of the light from said reflective surface area being larger than d.

2. A reflector for a lighting unit, said reflector having a generally concave surface, at least a portion of which concave surface includes a series of facets, each said facet having a reflective surface which is convex, wherein said reflective surfaces of all said facets are orientated to reflect light in a common direction, measured approximately at the midpoint of convex curvature of each said facet reflective surface, from a common light source location, and further wherein said reflective surface of each facet is set at an angle to said common direction, measured approximately at the midpoint of convex curvature of said reflective surface, which angle increases from one facet to the next with distance from said light source location.

3. The reflector of claim 2 wherein each said reflective surface area has a substantially constant radius of curvature.

4. The reflector of claim 2 wherein a back surface area of each said facet extends approximately from the outer edge of the reflective surface area of that facet to the inner edge of the reflective surface area of the adjacent facet and lies in a plane substantially parallel the direction of travel of light from said light source location to the intersection of said back surface area with the inner edge of the reflective surface area of said adjacent facet.

5. The reflector of claim 4 wherein the reflective surface area of each said facet is larger than that of the facet next closest to said light source location.

6. The reflector of claim 5 wherein the reflective surface area of all said facets, from said outer edge to said inner edge of each, intercepts an equal angle $\delta$ of light from said light source location.

7. The reflector of claim 6 wherein said angle $\delta$ is less than approximately 15°.

8. The reflector of claim 7 wherein the lateral dimension, d, of each said facet, being the sum of the lateral dimensions of the back surface area and of the reflective surface area of said facet, is equal to that of the other said facets.

9. A lighting unit comprising a light emitting element and a reflector having a generally concave surface to reflect light from said light emitting element, at least a portion of said concave surface including a series of facets, each said facet having a reflective surface exposed to said light emitting element which reflective surface is convex, wherein said reflective surfaces of all said facets are oriented to reflect light from the centerpoint of said light emitting element in a common direction, measured approximately at the midpoint of convex curvature of each said facet reflective surface, and further wherein said reflective surface of each facet is set at an angle to said common direction, measured approximately at the midpoint of convex curvature of said reflective surface, which angle increases from one facet to the next with distance from said light emitting element.

10. The lighting unit of claim 9 further comprising a lens vertically spaced from said reflector, wherein the reflective surface areas are sufficiently convex to cause substantial overlapping at said lens, laterally, of the light reflected by the reflective surface area of each said facet with that reflected by adjacent facets.

11. The lighting unit of claim 9 wherein each said reflective surface area has a substantially constant radius of curvature.

12. The lighting unit of claim 9 wherein a back surface area of each said facet extends approximately from an outermost point of the reflective surface area of that facet to an innermost point of the reflective surface area of the adjacent facet and lies in a plane substantially parallel the direction of travel of light from said light source location to the intersection of said back surface area with said innermost point of the reflective surface area of said adjacent facet.

13. The lighting unit of claim 12 wherein the reflective surface area of each said facet is larger than that of the facet next closest to said light emitting element.

14. The lighting unit of claim 13 wherein the reflective surface area of each said facet, from said outermost point to said innermost point of each, intercepts an equal angle $\delta$ of light from said light emitting element.

15. The lighting unit of claim 14 wherein said angle $\delta$ is less than approximately 15°.

16. The lighting unit of claim 15 wherein the lateral dimension, d, of each said facet, being the sum of the lateral dimensions of the back surface area and of the reflective surface area of said facet, is equal to that of the other said facets.

* * * * *